US006113268A

United States Patent [19]

Thompson

[11] Patent Number: 6,113,268

[45] Date of Patent: Sep. 5, 2000

[54] WEIGHTED CARRYING CASE

[76] Inventor: George W. Thompson, 859 S. Larch Ave., Rialto, Calif. 92376

[21] Appl. No.: 09/176,834

[22] Filed: Oct. 22, 1998

[51] Int. Cl.[7] ..... B65D 30/22

[52] U.S. Cl. ..... 383/40; 109/50; 150/102; 190/101; 190/111; 190/903; 220/522; 383/97

[58] Field of Search ..... 150/102, 119; 190/101, 111, 903; 383/38, 40, 97; 109/50; 206/316.1–316.3; 220/522

[56] References Cited

U.S. PATENT DOCUMENTS

| | | | |
|---|---|---|---|
| 1,348,134 | 7/1920 | Barnstead | 220/603 |
| 1,662,171 | 3/1928 | Savery | 220/603 |
| 2,556,066 | 6/1951 | Cline | 190/903 |
| 2,691,401 | 10/1954 | Kontoff et al. | 190/111 |
| 2,960,137 | 11/1960 | Lipsitz | 206/316.2 |
| 2,988,125 | 6/1961 | Reynolds | 190/111 |
| 4,431,041 | 2/1984 | Leiserson | 206/316.2 |
| 4,438,606 | 3/1984 | Chardon et al. | 109/50 |
| 4,475,101 | 10/1984 | Kulp et al. | 220/603 |
| 4,664,041 | 5/1987 | Wood | 109/50 |
| 4,693,344 | 9/1987 | Shuler | 190/111 |
| 4,713,033 | 12/1987 | Cameron | 383/121 |
| 4,792,026 | 12/1988 | Dimmick et al. | 383/97 |
| 4,979,339 | 12/1990 | Jones et al. | 150/166 |
| 5,199,361 | 4/1993 | Robinson | 109/50 |
| 5,201,867 | 4/1993 | Morszeck | 206/316.2 |
| 5,205,448 | 4/1993 | Kester et al. | 206/316.2 |
| 5,226,464 | 7/1993 | Solov | 150/159 |
| 5,429,541 | 7/1995 | Landon | 383/4 |
| 5,439,109 | 8/1995 | McBride | 383/111 |
| 5,693,398 | 12/1997 | Granger | 383/4 |
| 5,774,912 | 7/1920 | Dominique | 5/417 |

*Primary Examiner*—Stephen P. Garbe

[57] ABSTRACT

A carrying case is provided including a base with an open top. Also included is a top assembly have a top face with a downwardly extending peripheral lip integrally coupled thereto and depending therefrom for defining an interior space and an open bottom with a lower peripheral edge. The lower peripheral edge of the top assembly is hingably coupled to the base. The top assembly further includes a cover for selectively closing the interior space thereof.

7 Claims, 2 Drawing Sheets

WEIGHTED CARRYING CASE

BACKGROUND OF THE INVENTION

1. Field of the Invention

The present invention relates to carrying cases and more particularly pertains to a new weighted carrying case for preventing the theft of valuables at a beach or similar place.

2. Description of the Prior Art

The use of carrying cases is known in the prior art. More specifically, carrying cases heretofore devised and utilized are known to consist basically of familiar, expected and obvious structural configurations, notwithstanding the myriad of designs encompassed by the crowded prior art which have been developed for the fulfillment of countless objectives and requirements.

Known prior art carrying cases include U.S. Pat. No. 4,664,041; U.S. Pat. No. 5,452,877; U.S. Pat. No. 4,062,207; U.S. Pat. No. 3,226,737; U.S. Pat. No. 4,436,214; and U.S. Pat. No. 1,291,051.

In these respects, the weighted carrying case according to the present invention substantially departs from the conventional concepts and designs of the prior art, and in so doing provides an apparatus primarily developed for the purpose of preventing the theft of valuables at a beach or similar place.

SUMMARY OF THE INVENTION

In view of the foregoing disadvantages inherent in the known types of carrying cases now present in the prior art, the present invention provides a new weighted carrying case construction wherein the same can be utilized for preventing the theft of valuables at a beach or similar place.

The general purpose of the present invention, which will be described subsequently in greater detail, is to provide a new weighted carrying case apparatus and method which has many of the advantages of the carrying cases mentioned heretofore and many novel features that result in a new weighted carrying case which is not anticipated, rendered obvious, suggested, or even implied by any of the prior art carrying cases, either alone or in any combination thereof.

To attain this, the present invention generally comprises a base constructed from a flexible material. The base includes a rectangular bottom face and a peripheral side wall integrally coupled to a periphery of the bottom face and extended upwardly therefrom. As such, the base defines a rectangular open top with an upper peripheral edge formed of a pair of elongated side edges and a pair of short end edges. The base includes a flexible rectangular lid having a periphery with a short end edge integrally coupled to one of the short end edges of the upper peripheral edge of the base. As shown in FIG. 2, a remaining portion of the periphery of the lid has a first zipper portion mounted thereon for releasably securing to a second zipper portion mounted to the upper peripheral edge of the base. Also included is a top assembly constructed from a flexible material. The top assembly includes a top face with a downwardly extending peripheral lip integrally coupled thereto and depending therefrom. By this structure, an interior space and an open bottom of the top assembly is defined with a lower peripheral edge. It should be noted that a short end edge of the lower peripheral lip is integrally coupled to one of the short end edges of the base for affording a living hinge. The top assembly further includes a flexible rectangular cover having a periphery with a short end edge integrally coupled to a short end edge of the lower peripheral edge of the top assembly. Similar to the lid of the base, a remaining portion of the periphery of the cover has a third zipper portion mounted thereon for releasably securing to a fourth zipper portion which is mounted to the lower peripheral edge of the top assembly. For releasably securing the top assembly to the base, a fifth zipper portion is mounted about the lower peripheral edge of the top assembly and depends downwardly therefrom. Associated therewith is a sixth zipper portion mounted about the upper peripheral edge of the base for releasably securing the top assembly on top of the base. In use, the lid of the base and the cover of the top assembly may be exposed upon the releasing of the fifth zipper portion and the sixth zipper portion. Next provided is a carrying strap assembly including a pair of eyelets formed on opposed side faces of the side wall of the base. Such eyelets are situated just below opposed short end edges of the base. An elongated strap has ends equipped with couples for releasably connecting with the eyelets. Finally, a locking unit includes a tab connected to a zipper associated with the fifth and sixth zipper portions via a string. The locking unit further includes a combination-type cylindrical lock fixedly mounted to the top assembly adjacent to a termination of the fifth and sixth zipper portions for lockably receiving the tab. The locking unit works to preclude the exposure of the lid of the base and the cover of the top assembly.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new weighted carrying case apparatus and method which has many of the advantages of the carrying cases mentioned heretofore and many novel features that result in a new weighted carrying case which is not anticipated, rendered obvious, suggested, or even implied by any of the prior art carrying cases, either alone or in any combination thereof.

It is another object of the present invention to provide a new weighted carrying case which may be easily and efficiently manufactured and marketed.

It is a further object of the present invention to provide a new weighted carrying case which is of a durable and reliable construction.

An even further object of the present invention is to provide a new weighted carrying case which is susceptible of a low cost of manufacture with regard to both materials and labor, and which accordingly is then susceptible of low prices of sale to the consuming public, thereby making such weighted carrying case economically available to the buying public.

Still yet another object of the present invention is to provide a new weighted carrying case which provides in the apparatuses and methods of the prior art some of the advantages thereof, while simultaneously overcoming some of the disadvantages normally associated therewith.

Still another object of the present invention is to provide a new weighted carrying case for preventing the theft of valuables at a beach or similar place.

Even still another object of the present invention is to provide a new weighted carrying case that includes a base with an open top. Also included is a top assembly have a top face with a downwardly extending peripheral lip integrally coupled thereto and depending therefrom for defining an interior space and an open bottom with a lower peripheral edge. A short end edge of the lower peripheral edge is integrally coupled to the base for affording a living hinge. The top assembly further includes a cover for selectively closing the interior space thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
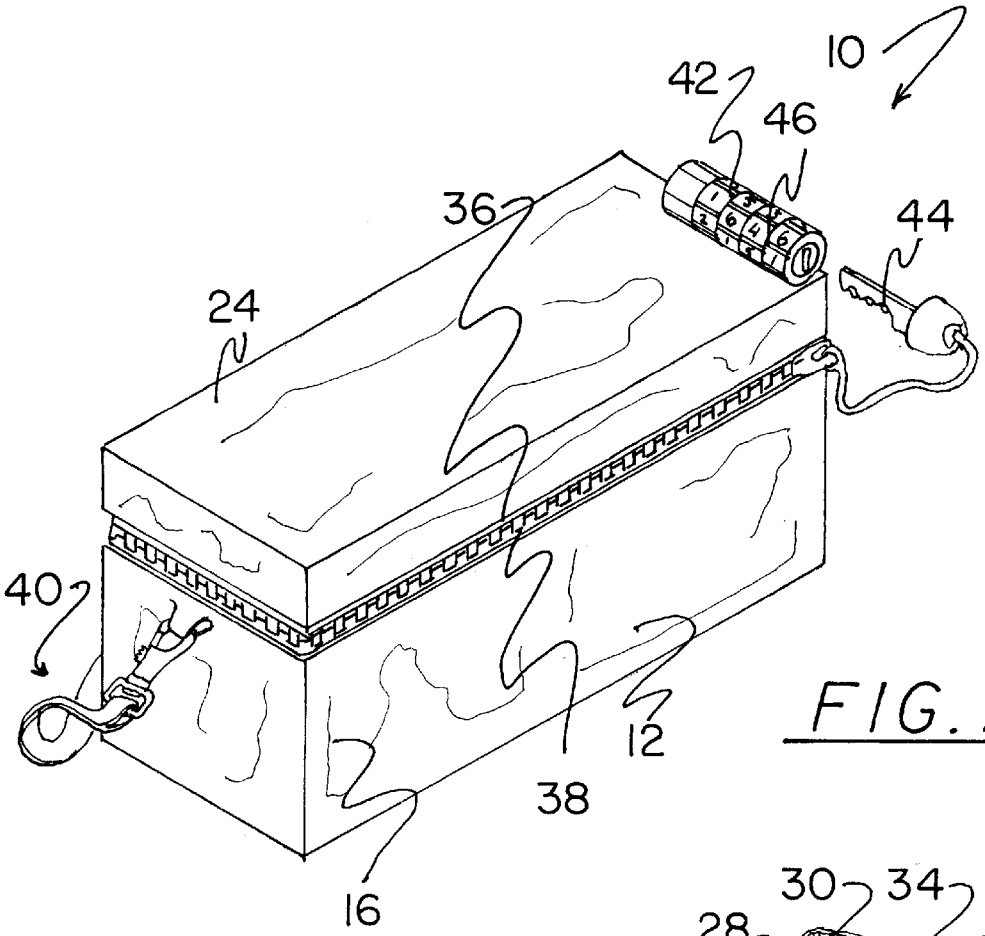
FIG. 1 is a perspective view of a new weighted carrying case according to the present invention.

With reference now to the drawings, and in particular to FIGS. 1 through 4 thereof, a new weighted carrying case embodying the principles and concepts of the present invention and generally designated by the reference numeral 10 will be described.

The present invention, designated as numeral 10, includes a base 12 constructed from a flexible material. The base includes a rectangular bottom face 14 and a peripheral side wall 16 integrally coupled to a periphery of the bottom face and extended upwardly therefrom. As such, the base defines a rectangular open top with an upper peripheral edge formed of a pair of elongated side edges and a pair of short end edges.

Figure 2:
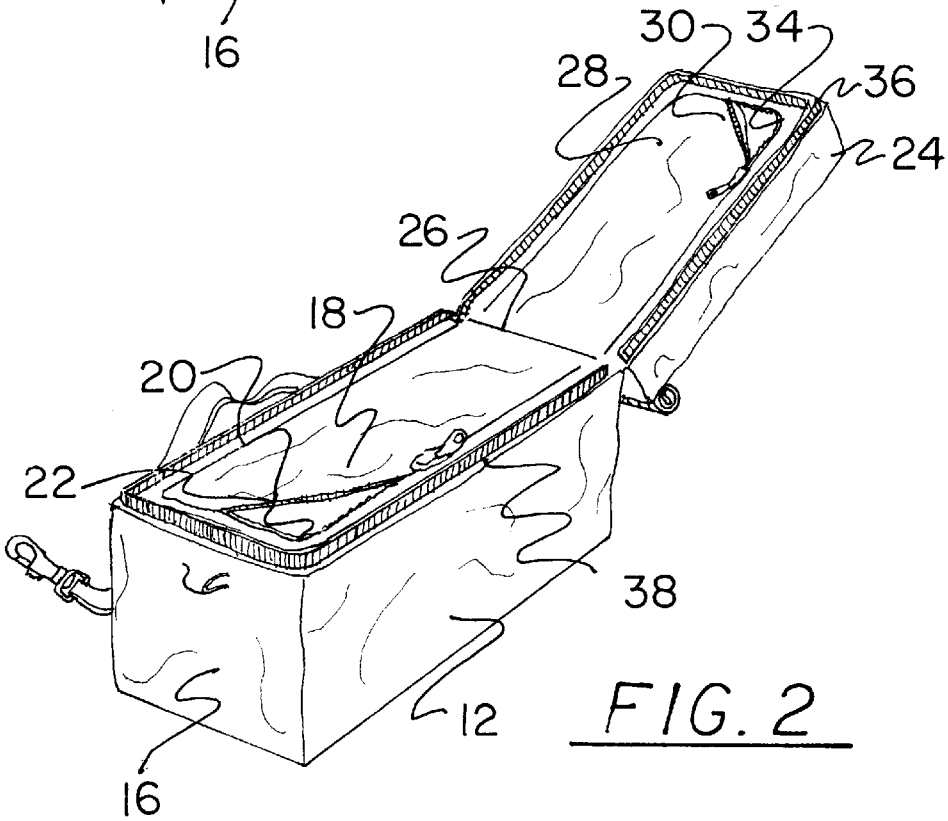
FIG. 2 is a perspective view of the present invention with the top assembly decoupled from the base.
Figure 3:
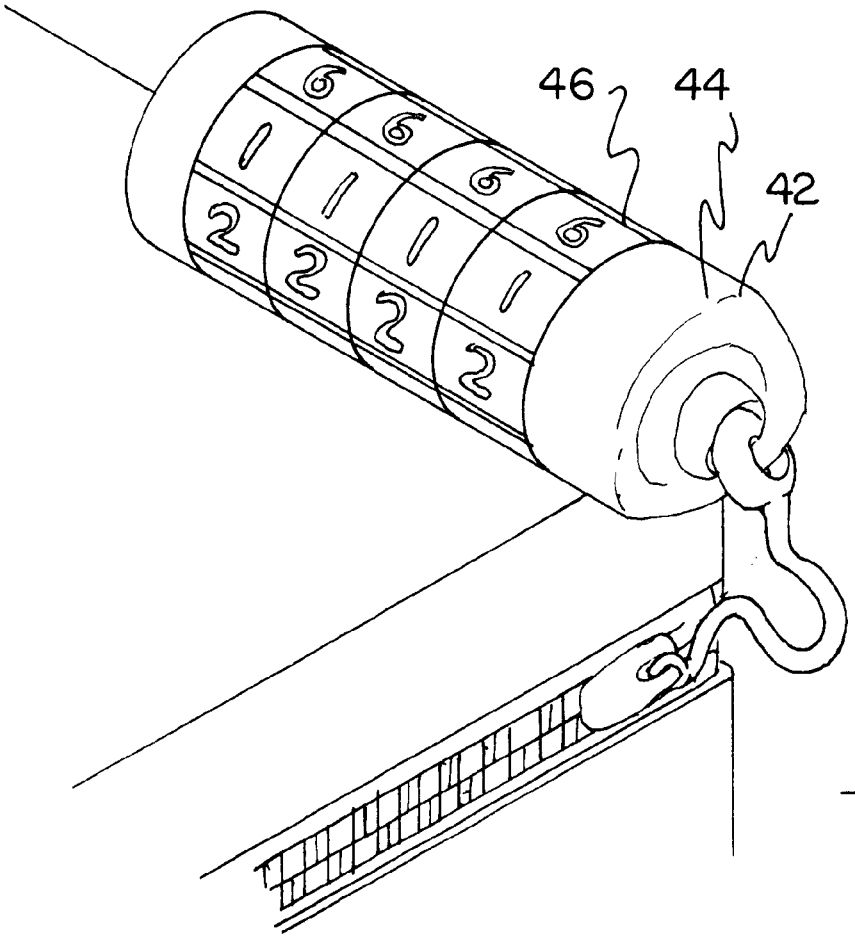
FIG. 3 is a detailed perspective view of the locking unit of the present invention.
Figure 4:
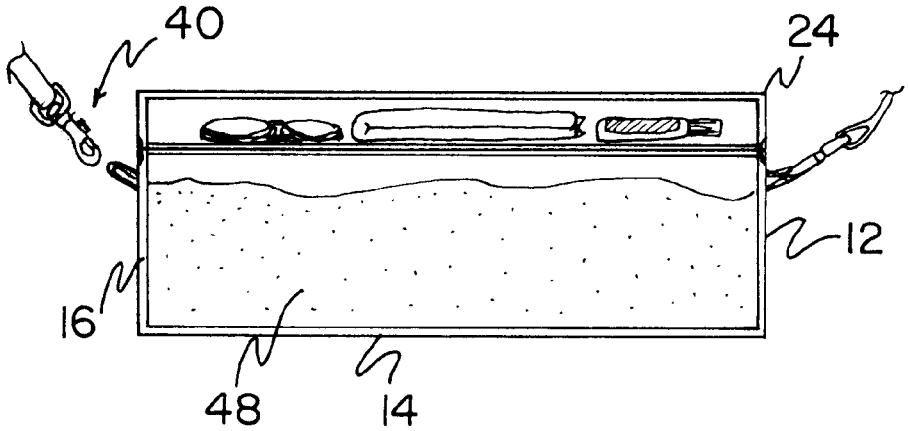
FIG. 4 is a side cross-sectional view of the present invention.

The base includes a flexible rectangular lid 18 having a periphery with a short end edge integrally coupled to one of the short end edges of the upper peripheral edge of the base. As shown in FIG. 2, a remaining portion of the periphery of the lid has a first zipper portion 20 mounted thereon for releasably securing to a second zipper portion 22 mounted to the upper peripheral edge of the base.

Also included is a top assembly 24 constructed from a flexible material. The top assembly includes a top face with a downwardly extending peripheral lip integrally coupled thereto and depending therefrom. By this structure, an interior space and an open bottom of the top assembly is defined with the open bottom having a lower peripheral edge. It should be noted that a short end edge of the lower peripheral lip is integrally coupled to one of the short end edges of the base for affording a living hinge 26. In the preferred embodiment, a height of the base is at least 3–4 times that of the top assembly. Further, the top assembly and base both have a common, constant horizontal cross-section along their height.

The top assembly further includes a flexible rectangular cover 28 having a periphery with a short end edge integrally coupled to a short end edge of the lower peripheral edge of the top assembly. Similar to the lid of the base, a remaining portion of the periphery of the cover has a third zipper portion 30 mounted thereon for releasably securing to a fourth zipper portion 34 which is mounted to the lower peripheral edge of the top assembly.

For releasably securing the top assembly to the base, a fifth zipper portion 36 is mounted about the lower peripheral edge of the top assembly and depends downwardly therefrom. Associated therewith is a sixth zipper portion 38 mounted about the upper peripheral edge of the base for releasably securing the top assembly on top of the base. In use, the lid of the base and the cover of the top assembly may be exposed upon the releasing of the fifth zipper portion and the sixth zipper portion. When the lid and cover are exposed, access may be gained to the interior space of the top assembly and base.

Next provided is a carrying strap assembly 40 including a pair of eyelets formed on opposed side faces of the side wall of the base. Such eyelets are situated just below opposed short end edges of the base. An elongated strap has ends equipped with couples for releasably connecting with the eyelets.

Finally, a locking unit 42 includes a tab 44 connected to a zipper associated with the fifth and sixth zipper portions via a cable or string. The locking unit further includes a combination-type cylindrical lock 46 fixedly mounted to the top assembly adjacent to a termination of the fifth and sixth zipper portions for lockably receiving the tab. The locking unit thus works to preclude the exposure of the lid of the base and the cover of the top assembly.

During use, the method associated with the present invention entails the insertion of at least 20–30 pounds of sand 48 within the interior space of the base. Thereafter, valuables may be stored in the interior space of the top assembly and the locking unit activated to prevent access thereto. With the immense weight situated within the base, the present invention and valuables are incapable of being stolen without extraordinary measures.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A weighted carrying case comprising, in combination:

a base constructed from a flexible material and including a rectangular bottom face and a peripheral side wall integrally coupled to a periphery of the bottom face and extended upwardly therefrom for defining a rectangular open top with an upper peripheral edge defined by a pair of elongated side edges and a pair of short end edges, the base including a flexible rectangular lid having a periphery with a short end edge integrally coupled to one of the short end edges of the upper peripheral edge of the base, wherein a remaining portion of the periphery of the lid has a first zipper portion mounted thereon for releasably securing to a second zipper portion mounted to the upper peripheral edge of the base;

a top assembly constructed from a flexible material and including a top face with a downwardly extending peripheral lip integrally coupled thereto and depending therefrom for defining an interior space and an open bottom with a lower peripheral edge, wherein a short end edge of the lower peripheral lip is integrally coupled to one of the short end edges of the base for affording a living hinge, the top assembly further including a flexible rectangular cover having a periphery with a short end edge integrally coupled to a short end edge of the lower peripheral edge of the top assembly, wherein a remaining portion of the periphery of the cover has a third zipper portion mounted thereon for releasably securing to a fourth zipper portion mounted to the lower peripheral edge of the top assembly;

wherein a fifth zipper portion is mounted about the lower peripheral edge of the top assembly and depending downwardly therefrom and a sixth zipper portion is mounted about the upper peripheral edge of the base for releasably securing the top assembly on top of the base, whereby the lid of the base and the cover of the top assembly may be exposed upon the releasing of the fifth zipper portion and the sixth zipper portion;

a carrying strap assembly including a pair of eyelets formed on opposed side faces of the side wall of the base just below opposed short end edges of the base and an elongated strap having ends equipped with couples for releasably connecting with the eyelets;

a locking unit including a tab connected to a zipper associated with the fifth and sixth zipper portions via a string, the locking unit further including a cylindrical lock fixedly mounted to the top assembly adjacent to a termination of the fifth and sixth zipper portions for lockably receiving the tab, thereby precluding the exposure of the lid of the base and the cover of the top assembly; and at least 20 pounds of sand situated within the interior space of the base.

2. A carrying case comprising:

a base with an open top;

a top assembly including a top face with a downwardly extending peripheral lip integrally coupled thereto and depending therefrom for defining an interior space and an open bottom with a lower peripheral edge, wherein the lower peripheral edge is hingably coupled to the base, the top assembly further including a cover for selectively closing the interior space thereof; and wherein the base is filled with a predetermined amount of sand.

3. A carrying case as set forth in claim 2 wherein the base has a carrying strap mounted thereon.

4. A carrying case as set forth in claim 3 wherein the carrying strap is releasably mounted to the base.

5. A carrying case as set forth in claim 2 wherein the top assembly is releasably secured over the open top of the base by way of a zipper.

6. A carrying case as set forth in claim 5 wherein the zipper has a lock for selectively precluding the movement thereof.

7. A carrying case as set forth in claim 2 wherein the base is equipped with a lid for closing the open top thereof.

* * * * *